US005585324A

United States Patent [19]

Martin et al.

[11] Patent Number: 5,585,324

[45] Date of Patent: Dec. 17, 1996

[54] BACKING LAYER FOR RECEIVER USED IN THERMAL DYE TRANSFER

[75] Inventors: Thomas W. Martin, Rochester; Ronald S. King, Fairport, both of N.Y.

[73] Assignee: Eastman Kodak Company, Rochester, N.Y.

[21] Appl. No.: 591,753

[22] Filed: Jan. 25, 1996

[51] Int. Cl.[6] ..... B41M 5/035; B41M 5/38

[52] U.S. Cl. ..... 503/227; 428/195; 428/331; 428/341; 428/520; 428/704; 428/913; 428/914

[58] Field of Search ..... 8/471; 428/195, 428/331, 341, 520, 704, 913, 914; 503/227

[56] References Cited

U.S. PATENT DOCUMENTS 5,198,408 3/1993 Martin ..... 503/227

*Primary Examiner*—Bruce H. Hess
*Attorney, Agent, or Firm*—Harold E. Cole

[57] ABSTRACT

A dye-receiving element for thermal dye transfer comprising a support having on one side thereof a polymeric dye image-receiving layer and on the other side thereof a backing layer comprising a polymeric binder, submicron inorganic particles, a polymeric acid, an ionic antistatic material and an organometallic complex.

20 Claims, No Drawings

BACKING LAYER FOR RECEIVER USED IN THERMAL DYE TRANSFER

This invention relates to dye-receiving elements used in thermal dye transfer, and more particularly to a backing layer for such elements to improve their transport through thermal printers.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to a cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye receiving elements for thermal dye transfer generally comprise a transparent or reflective support having on one side thereof a dye image-receiving layer and on the other side thereof a backing layer. As set forth in U.S. Pat. Nos. 5,011,814 and 5,096,875, the disclosures of which are incorporated by reference, the backing layer material is chosen to (1) provide adequate friction to a thermal printer rubber picker roller to allow for removal of one receiver element at a time from a thermal printer receiver element supply stack, (2) minimize interactions between the front and back surfaces of receiving elements such as dye retransfer from one imaged receiving element to the backing layer of an adjacent receiving element in a stack of imaged elements, and (3) minimize sticking between a dye-donor element and the receiving element backing layer when the receiving element is accidentally inserted into a thermal printer wrong side up.

Additionally, especially for transparent receiving elements (e.g., elements used for printing overhead transparencies, the supports of which generally comprise smooth polymeric films), static charges may be easily generated upon transport of the elements through a thermal printer. As such, it is preferable for the backing layer (or an additional layer) to provide sufficient surface conductivity to dissipate such charges.

U.S. Pat. No. 5,198,408 relates to a backing layer for a thermal dye transfer receiver which contains a polymeric binder, submicron inorganic particles and larger polymeric particles. While this backing layer has proven to be effective, there are problems with it in some applications in that dirt and other particles tend to accumulate under the print head at low relative humidity (RH) levels which may cause deterioration of the printed image. Also, at high RH levels, there are "mispicks" by the picker roller in the printer when removing one receiver element from a stack of receiver elements.

It is an object of the present invention to provide a thermal dye-receiving element with a backing layer that has sufficient surface conductivity to dissipate charges generated upon transport of the element through a thermal printer at low RH levels, and that contains no large matte particles which could contribute to the undesirable accumulation of debris within the printer path. It is another object of this invention to provide a thermal dye-receiving element with a backing layer which would provide a higher coefficient of friction (COF) between the backing layer and the picker roller in a thermal printer to allow for removal of receiver elements one at a time from a receiver element supply stack and avoid mispicks at any RH level.

These and other objects are achieved in accordance with this invention which comprises a dye-receiving element for thermal dye transfer comprising a support having on one side thereof a polymeric dye image-receiving layer and on the other side thereof a backing layer comprising a polymeric binder, submicron inorganic particles, a polymeric acid, an ionic antistatic material and an organometallic complex.

It has been found unexpectedly that the backing layer of the invention has a lower surface electrical resistivity (SER) which provides improved antistatic properties at all RH levels. This backing layer also provides the desired higher COF between the backing layer and the picker roller so that the likelihood of a mispick is reduced at any RH level. Further, by not having large matte particles in the backing layer, there is less accumulation of debris in the printer.

The polymeric binder employed in the backing layer of the invention can be any of those materials commonly used for this purpose. There can be employed, for example, poly(ethylene oxide), poly(ethylene glycol), poly(vinyl alcohol) (PVA), etc. In a preferred embodiment of the invention, PVA is employed.

The PVA employed in a preferred embodiment of the invention is preferably essentially fully hydrolyzed and of a molecular weight sufficient to provide a solution viscosity for coating of 10 to 90 cp. Other polymeric binders may be used in combination with the PVA if desired. Preferably, the total amount of polymeric binder comprises from about 10 to about 80 wt. % of the backing layer, with at least about one-half, preferably at least about two-thirds, of the polymeric binder by weight being PVA.

The submicron colloidal inorganic particles employed in the backing layer of the invention preferably comprise from about 15 to about 80 wt. % of the backing layer mixture of the invention. While any submicron colloidal inorganic particles may be used, the particles preferably are water dispersible and less than 0.1 μm in size, and more preferably from about 0.01 to 0.05 μm in size. There may be used, for example, silica, alumina, titanium dioxide, barium surfate, etc. In a preferred embodiment, silica particles are used.

The polymeric acid employed in the backing layer of the invention may be, for example, poly(acrylic acid), poly(methacrylic acid), poly(styrene sulfonic acid), etc. It may be employed at a coverage of from about 0.01 to about 0.05 $g/m^2$, preferably from about 0.025 to about 0.035 $g/m^2$.

Ionic antistatic agents useful in the backing layer of the invention include materials such as alkali metal salts, vanadium pentoxide, or others known in the art. In a preferred embodiment, alkali metal salts are employed such as potassium acetate, sodium acetate, potassium chloride, sodium chloride, potassium nitrate, sodium nitrate, lithium nitrate, potassium formate, sodium formate, etc. These salts may be employed at a coverage of from about 0.02 to about 0.05 $g/m^2$, preferably about 0.03 to about 0.04 $g/m^2$.

The organometallic complex useful in this invention may be, for example, an organic titanate such as titanium diisopropylate di(triethanolamine), available commercially as Tyzor® Te (DuPont Corp.), titanium tetraethoxide or tetrabutoxide, or mixtures thereof such as Tyzor® GBA or Tyzor® DEA; or a chromium organocomplex. The complex may be employed at a coverage of from about 0.006 to about 0.02 g/m$^2$, preferably from about 0.008 to about 0.012 g/m$^2$.

A process of forming a dye transfer image in a dye-receiving element in accordance with this invention comprises removing an individual dye-receiving element as described above from a supply stack of dye-receiving elements, moving the individual receiving element to a thermal printer printing station and into superposed relationship with a dye-donor element comprising a support having thereon a dye-containing layer so that the dye-containing layer of the donor element faces the dye image-receiving layer of the receiving element, and imagewise heating the dye-donor element thereby transferring a dye image to the individual receiving element. The process of the invention is applicable to any type of thermal printer, such as a resistive head thermal printer, a laser thermal printer, or an ultrasound thermal printer.

Additional materials may also be added to the backing layer of the invention. For example, improved pencil writeability can be obtained, if desired, by the addition of calcined clay. Calcined clays are essentially aluminum silicates that have been heated to remove water of hydration. These materials generally have a particle size of 0.5 to 4 μm, preferably 1 to 2 μm, and may be added at up to 60%, preferably 30–40%, by weight of the backing layer to provide improved writeability. Commercially available materials and their average particle size include: Satintone Special (Engelhard Industries), approx 1.2 μm; Icecap K (Burgess Pigment), approx. 1.0 μm; Altowhite LL (Georgia Kaolin), approx. 1.8 μm; and Glomax JDF (Georgia Kaolin), approx. 0.9 μm. Surfactants and other conventional coating aids may also be used in the backing layer coating mixture.

The backing layer of the invention may be present in any amount which is effective for the intended purpose. In general, good results have been obtained at a total coverage of from about 0.1 to about 2.5 g/m$^2$.

For a thermal dye-transfer receiver designed for reflection viewing (such as one having an opaque support), a total backing layer coverage of from about 0.5 to about 2.5 g/m$^2$ is preferred. For this backing layer, the total amount of polymeric binder preferably comprises from about 10 to about 40 wt. % of the backing layer, and a total polymeric binder coverage of about 0.1 to 0.4 g/m$^2$ is preferred.

For a thermal dye-transfer transparency receiver (e.g., one designed for transmission viewing and having a transparent film support), a lower total backing layer coverage of from about 0.1 to about 0.6 g/m$^2$ is preferred. A backing layer coverage greater than 0.6 g/m$^2$ tends to have too much haze for transparency applications. For this backing layer, the total amount of polymeric binder preferably comprises from about 40 to about 80 wt. % of the backing layer, and a total polymeric binder coverage of about 0.05 to 0.4 g/m$^2$ is preferred. Additionally, at least about three-fourths of the polymer weight should be poly(vinyl alcohol). An especially preferred polymer coverage is poly(vinyl alcohol) and poly(ethylene oxide) at 0.06 g/m$^2$ and 0.02 g/m$^2$ respectively. The total polymer coverage is more preferably maintained below 0.25 g/m$^2$ to avoid haze.

The support for the dye-receiving element of the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 gm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

The dye image-receiving layer of the receiving elements of the invention may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at from about 1 to about 10 g/m$^2$. An overcoat layer may be further coated over the dye-receiving layer such as those described in U.S. Pat. No. 4,775,657, the disclosure of which is incorporated by reference.

Conventional dye-donor elements may be used with the dye-receiving element of the invention. Such donor elements generally comprise a support having thereon a dye-containing layer. Any dye may be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the dye transfer process steps are sequentially performed for each color to obtain a three-color dye transfer image.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer, such as laser or ultrasound, may be used.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought into register with the dye-receiving element and the process repeated. The third color is obtained in the same manner.

The following example is provided to further illustrate the invention.

EXAMPLE

Dye-receiving elements were prepared which included a backing layer to establish its effect on SER. The support consisted of a paper stock from a blend of Pontiac Maple 51 (a bleached maple hardwood kraft of 0.5 μm length weighted average fiber length) available from Consolidated Pontiac, Inc. and Alpha Hardwood Sulfite (a bleached red-alder hardwood sulfite pulp of 0.69 μm average fiber length) available from Weyerhauser Paper Co.. The support had a clear polyethylene layer laminated to it. The backing layer was then applied as described in Table 1.

The other side of this support had a microvoided packaging film of OPPalyte® 350 TWK, polypropylene-laminated paper support with a lightly $TiO_2$-pigmented polypropylene skin (Mobil Chemical Co.) at a dry coverage of 0.11 g/m$^2$, 36 gm thick, d=0.62, laminated to it. A subbing lager of an aminofunctional organo-oxysilane Prosil 221® with a hydrophobic organooxysilane, Prosil 2210®, which is an epoxy-terminated organo-oxysilane was prepared by diluting the original material with 3A alcohol and 1% water and coating on the support at a coverage of 0.11 g/m$^2$.

The subbing layer was then overcoated with a dye-receiving layer containing MakroIon® polyether-modified bisphenol-A polycarbonate block copolymer (Bayer AG) (1.62 g/m$^2$), KL3-1013 bisphenol-A polycarbonate (General Electric Co.) (1.62 g/m$^2$), Fluorad FC-431® perfluorinated alkylsulfonamidoalkyl ester surfactant (3M Co.) (0.011 g/m$^2$), di-n-butyl phthalate (0.32 g/m$^2$), and diphenyl phthalate (0.32 g/m$^2$) coated from methylene chloride.

The dye-receiving layer was then overcoated with a solvent mixture of methylene chloride and trichloroethylene containing a polycarbonate random terpolymer of bisphenol A (50 mole %), diethylene glycol (49 mole %), and polydimethylsiloxane (1 mole %), (2500 MW) block units (0.22 g/m$^2$); Fluorad FC-431® surfactant (0.017 g/m$^2$); and DC-510 surfactant (Dow-Corning Corp.)(0.0083 g/m$^2$).

The following backing layer coatings were employed:

TABLE 1

| Element | Backing Layer Components (coated from water/butanol mixture) | Dry Coverage (g/m$^2$) |
|---|---|---|
| Control 1 (C-1) | PVA | 0.16 |
| | PEO | 0.07 |
| | Silica | 0.54 |
| | Glucopon 225 ® surfactant (Henkel Corp.) | 0.03 |
| | Triton X-200E ® surfactant (Rohm & Haas) | 0.02 |
| | poly(styrene-divinyl benzene 95/5) 4 μm beads | 0.27 |
| Comparison (C-2) | PVA | 0.16 |
| | PEO | 0.07 |
| | Silica | 0.54 |
| | Glucopon 225 ® surfactant | 0.03 |

TABLE 1-continued

| Element | Backing Layer Components (coated from water/butanol mixture) | Dry Coverage (g/m$^2$) |
|---|---|---|
| | potassium acetate | 0.03 |
| | Tyzor TE ® (titanium tetra-ethoxide) (DuPont) | 0.01 |
| E-1 | PVA | 0.16 |
| | Silica | 0.54 |
| | Glucopon 225 ® surfactant | 0.01 |
| | potassium acetate | 0.03 |
| | poly(acrylic acid) | 0.02 |
| | Tyzor TE ® (titanium tetra-ethoxide) | 0.01 |
| E-2 | PVA | 0.27 |
| | Silica | 0.54 |
| | Glucopon 225 ® surfactant | 0.01 |
| | potassium acetate | 0.05 |
| | poly(acrylic acid) | 0.03 |
| | Volan ® (chromium organo complex) (DuPont) | 0.02 |
| E-3 | PVA | 0.19 |
| | Silica | 0.39 |
| | Glucopon 225 ® surfactant | 0.01 |
| | potassium acetate | 0.04 |
| | poly(acrylic acid) | 0.02 |
| | Volan ® (chromium organo complex) | 0.01 |
| E-4 | PVA | 0.14 |
| | Silica | 0.28 |
| | Glucopon 225 ® surfactant | 0.004 |
| | potassium acetate | 0.03 |
| | poly(acrylic acid) | 0.02 |
| | Tyzor TE ® (titanium tetra-ethoxide) | 0.01 |
| E-5 | PVA | 0.23 |
| | Silica | 0.46 |
| | Triton X-200E ® | 0.01 |
| | potassium acetate | 0.04 |
| | poly(acrylic acid) | 0.03 |
| | Tyzor TE ® (titanium tetra-ethoxide) | 0.02 |
| E-6 | PVA | 0.23 |
| | Silica | 0.45 |
| | Glucopon 225 ® surfactant | 0.01 |
| | potassium acetate | 0.03 |
| | poly(acrylic acid) | 0.03 |
| | Tyzor TE ® (titanium tetra-ethoxide) | 0.02 |

PVA is Colloids 7190-25 poly(vinyl alcohol) (Colloid Industries)

PEO is Polyox®WSR N-10 poly(ethylene oxide),. MW 900,000 (Scientific Polymer Products)

Silica is Ludox AM® (aqueous dispersion of alumina-modified colloidal silica particles, 13 μm) (DuPont Corp.)

SER values at 20% RH and 50% RH and 20° C. were measured and are shown in Table 2 below. The average of four readings at different areas on a page size sample is reported for each RH.

TABLE 2

| Element | SER at 20% RH ohm/square | SER at 50% RH ohm/square |
|---|---|---|
| Control 1 | $>1 \times 10^{14}$ | $2.51 \times 10^{12}$ |
| Comparison 2 | $3.98 \times 10^{13}$ | $2.00 \times 10^{11}$ |
| E-1 | $3.98 \times 10^{12}$ | $3.16 \times 10^{9}$ |
| E-2 | $3.16 \times 10^{11}$ | $1.26 \times 10^{9}$ |
| E-3 | $1.26 \times 10^{12}$ | $1.26 \times 10^{9}$ |
| E-4 | $2.51 \times 10^{11}$ | $6.31 \times 10^{8}$ |
| E-5 | $2.00 \times 10^{11}$ | $1.26 \times 10^{9}$ |

TABLE 2-continued

| Element | SER at 20% RH ohm/square | SER at 50% RH ohm/square |
|---|---|---|
| E-6 | $7.94 \times 10^{11}$ | $2.00 \times 10^{9}$ |

The above data show that a significant reduction in SER is achieved with backing layer formulations of the present invention as compared to the Control and Comparison elements. Lower values of SER are an indication that less dirt will be attracted by static charging.

The COF for each receiver sample against a stalled picker roller was determined according to an in-house "incline test" procedure by placing a test sample on an inclined fixture against the picker rollers of a thermal printer and holding the sample in place with a block. The fixture is then inclined until the test sample starts to be transported across the picker rollers. The angle (in degrees) at which this occurs is recorded. The COF is reported as the tangent of this angle.

Measurements of the COF were made with each sample conditioned at 20% RH, 50% RH, and 85% RH. The following results were obtained:

TABLE 3

| | COF | | |
|---|---|---|---|
| Element | 20% RH | 50% RH | 85% RH |
| Control 1 | 0.88 | 0.71 | 0.51 |
| Comparison 2 | 0.86 | 0.72 | 0.53 |
| E-1 | 1.22 | 1.04 | 0.80 |
| E-2 | 1.27 | 1.23 | 0.83 |
| E-3 | 1.10 | 1.04 | 0.85 |
| E-4 | 1.00 | 0.98 | 0.73 |
| E-5 | 1.31 | 1.08 | 0.64 |
| E-6 | 1.27 | 1.22 | 0.82 |

The above data show that the elements of the invention have higher COF values at all three levels of RH as compared to the Control and Comparison elements. Higher COF values is an indication that there will be a fewer number of receiver mispicks, multiple picks and jams.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a polymeric dye image-receiving layer and on the other side thereof a backing layer comprising a polymeric binder, submicron inorganic particles, a polymeric acid, an ionic antistatic material and an organometallic complex.

2. The dement of claim 1 wherein said polymeric binder is poly(vinyl alcohol) and said inorganic particles are silica.

3. The element of claim 1 wherein said polymeric acid is poly(acrylic acid).

4. The element of claim 1 wherein said ionic antistatic material is an alkali metal salt.

5. The dement of claim 4 wherein said alkali metal salt is potassium acetate.

6. The element of claim 1 wherein said organometallic complex is an organic titanate.

7. The element of claim 6 wherein said organic titanate is titanium diisopropylate di(triethanolamine).

8. The dement of claim 1 wherein said organometallic complex is a chromium organo complex.

9. The element of claim 1 wherein the total coverage of said backing layer is from 0.1 to 2.5 $g/m^2$.

10. A process of forming a dye transfer image in a dye-receiving element comprising:

(a) removing an individual dye-receiving element comprising a support having on one side thereof a polymeric dye image-receiving layer and on the other side thereof a backing layer from a stack of dye-receiving elements;

(b) moving said individual dye-receiving element to a thermal printer printing station and into superposed relationship with a dye-donor element comprising a support having thereon a dye layer so that the dye layer of said dye-donor element faces said dye image-receiving layer of said dye-receiving element; and (c) imagewise-heating said dye-donor element and thereby transferring a dye image to said individual dye-receiving element;

wherein said backing layer comprises a polymeric binder, submicron inorganic particles, a polymeric acid, an ionic antistatic material and an organometallic complex.

11. The process of claim 10 wherein said polymeric binder is poly(vinyl alcohol) and said inorganic particles are silica.

12. The process of claim 10 wherein said polymeric acid is poly(acrylic acid).

13. The process of claim 10 wherein said ionic antistatic material is an alkali metal salt.

14. The process of claim 13 wherein said alkali metal salt is potassium acetate.

15. The process of claim 10 wherein said organometallic complex is titanium diisopropylate di(triethanolamine) or a chromium organo complex.

16. A thermal dye transfer assemblage comprising:

a) a dye-donor element comprising a support having thereon a dye layer, and b) a dye-receiving element comprising a support having thereon a dye image-receiving layer;

said dye-receiving element being in a superposed relationship with said dye-donor element so that said dye layer of said dye-donor element is in contact with said dye image-receiving layer of said dye-receiving element, said dye-donor element having on the other side thereof a backing layer comprising a polymeric binder, submicron inorganic particles, a polymeric acid, an ionic antistatic material and an organometallic complex.

17. The assemblage of claim 16 wherein said polymeric binder is poly(vinyl alcohol) and said inorganic particles are silica.

18. The assemblage of claim 16 wherein said polymeric acid is poly(acrylic acid) and said ionic antistatic material is an alkali metal salt.

19. The assemblage of claim 18 wherein said alkali metal salt is potassium acetate.

20. The assemblage of claim 16 wherein said organometallic complex is titanium diisopropylate di(triethanolamine) or a chromium organo complex.

* * * * *